US006570337B1

(12) United States Patent
Wakai et al.

(10) Patent No.: US 6,570,337 B1
(45) Date of Patent: May 27, 2003

(54) LUMINOUS DISPLAY UNIT

(75) Inventors: Hitoshi Wakai, Nagaoka (JP); Jun-Ichi Maruyama, Nagaoka (JP)

(73) Assignee: Nippon Seiki Co., Ltd., Niigata (JP)

( * ) Notice: Subject to any disclaimer, the term of this patent is extended or adjusted under 35 U.S.C. 154(b) by 0 days.

(21) Appl. No.: 09/914,164

(22) PCT Filed: Dec. 8, 2000

(86) PCT No.: PCT/JP00/08729

§ 371 (c)(1),
(2), (4) Date: Aug. 24, 2001

(87) PCT Pub. No.: WO01/48730

PCT Pub. Date: Jul. 5, 2001

(30) Foreign Application Priority Data

Dec. 24, 1999 (JP) ..... 11-365771

(51) Int. Cl.[7] ..... G09G 3/10

(52) U.S. Cl. ..... 315/169.3; 315/169.1; 313/497

(58) Field of Search ..... 315/169.1, 169.2, 315/169.3, 169.4, 375; 313/495, 497, 513

(56) References Cited

U.S. PATENT DOCUMENTS 4,218,636 A * 8/1980 Miyazawa ..... 315/169.1
4,278,917 A * 7/1981 Kobori ..... 315/169.1
4,459,514 A * 7/1984 Morimoto et al. ..... 315/169.1
4,595,862 A * 6/1986 Morimoto et al. ..... 315/169.1
4,658,186 A 4/1987 Horinouchi ..... 315/169.3
4,665,341 A * 5/1987 Imamura et al. ..... 313/493

FOREIGN PATENT DOCUMENTS

| | | |
|---|---|---|
| JP | 63-80596 | 5/1988 |
| JP | 80596/1988 | 5/1988 |
| JP | 6-32307 | 4/1994 |
| JP | 9-106887 | 4/1997 |
| JP | 10-293553 | 11/1998 |
| JP | 10-319910 | 12/1998 |
| JP | 11-87053 | 3/1999 |
| JP | 11-288243 | 10/1999 |
| JP | 11-305722 | 11/1999 |

OTHER PUBLICATIONS

International Search Report prepared by Japanese Patent Office.

* cited by examiner

*Primary Examiner*—Tho Phan
(74) *Attorney, Agent, or Firm*—McDermott, Will & Emery

(57) ABSTRACT

A luminous display unit 10.0 has plural segments 21*a* to 21*g* (light emitting portions) by using a self light emitting element reduced in light emitting luminance in accordance with a light emitting time and has differences in light emitting time in their light emitting portions. The light emitting luminance of a light emitting portion having a long light emitting time and the light emitting luminance of a light emitting portion having a short light emitting time at a using time of the luminous display unit 100 are set to be different from each other from the first so as not to recognize a difference in light emitting luminance caused between both the light emitting portions at said using time.

8 Claims, 4 Drawing Sheets

SEGMENT 2a = 7/10
SEGMENT 2b = 8/10
SEGMENT 2c = 9/10
SEGMENT 2d = 7/10
SEGMENT 2e = 4/10
SEGMENT 2f = 6/10
SEGMENT 2g = 7/10

LUMINOUS DISPLAY UNIT

TECHNICAL FIELD

This invention relates to a luminous display unit e.g., a luminous display unit using a self light emitting element such as an organic electroluminescence element (OLED), a fluorescent display tube, a light emitting diode (LED), etc.

BACKGROUND OF THE INVENTION

As shown in FIG. 5, an OLED 5 has at least an anode 2 constructed by a transparent electroconductive material such as indium, tin, oxide (ITO), etc., an organic layer 3 constructed by one or more layers (constructed by at least a single layer structure of an organic light emitting layer, or a multilayer structure in which a positive hole injecting layer, a positive hole transport layer, an electronic transport layer and an electronic injecting layer, etc. are laminated and formed from an anode side in accordance with the organic light emitting layer), and a cathode 4 constructed by a metallic electroconductive material such as aluminum (Al), etc. on a transparent substrate 1. For example, this OLED 5 is known in Japanese Patent Publication No. 32307/1994. The OLED 5 can emit light in a predetermined desirable pattern by shapes of the anode 2 and the cathode 4. Further, it is possible to perform display in constant electric current driving from a direct current power source vcc from several volts to several ten volts.

When a luminous display unit 100 using such an OLED 5 is utilized as a digital type distance recorder of a display unit for a vehicle, as shown in FIG. 6, the anode 2 is divided into seven segments 2*a* to 2*g* arranged in an 8-shape so that Arabic numerals "0" to "9" are artificially displayed. Numerals of plural digits can be displayed by arranging a plurality of such anodes in a transversal direction. For example, such a construction is known in Japanese Patent Laid-Open No. 106887/1997.

FIG. 6 shows an example of six-digit display able to display "000000" to "999999".

It is known that light emitting intensity in each of the segments 2*a* to 2*g* is reduced in accordance with a light emitting time. For example, when the light emitting time is ten thousand hours, light emitting luminance is reduced to about 50% of the original light emitting luminance.

If each of the segments 2*a* to 2*g* emits light for a uniform light emitting time, the reductions in light emitting luminance are uniform. Therefore, no difference in light emitting luminance between the respective segments 2*a* to 2*g* is almost caused irrespective of the length of a using time of the luminous display unit.

However, when there is a large difference in light emitting time, the difference in light emitting luminance is increased. Accordingly, as the using time of the luminous display unit is lengthened, this difference is enlarged. When these segments 2*a* to 2*g* simultaneously emit light, there is a case in which a feeling of physical disorder is felt by the difference in light emitting luminance. In such a state, goods property is greatly damaged.

In the case of the digital type distance recorder, light emitting frequency of each of the segments 2*a* to 2*g* in the display of numerals "0" to "9" of ten kinds in each digit is provided as shown in FIG. 7. In FIG. 7, the segment 2*c* has a maximum light emitting frequency of nine times, and the segment 2*e* has a minimum light emitting frequency of four times. When it is supposed that the light emitting time of each of the numerals "0" to "9" is uniform, the light emitting time of the segment 2*c* is 2.25 times the light emitting time of the segment 2*e*.

Accordingly, although it is the same digit, the light emitting luminance of the segment 2*c* is rapidly reduced in comparison with the light emitting luminance of the segment 2*e*. When this difference in light emitting luminance is increased to such an extent that this difference can be recognized, a problem exists in that a user has a feeling of physical disorder. When the difference in light emitting luminance is equal to or greater than a value corresponding to 30% of a higher light emitting luminance among these light emitting luminances, it is confirmed by an experiment of the present inventors, etc. that the difference in light emitting luminance between both the segments can be recognized.

When no numeral "0" is displayed on an upper digit side, i.e., when "120" having no numerals "0" in upper three digits is displayed as a blank display instead of "000120" displaying numerals "0" in the upper three digits in display of the numeral "120" (in the case of a so-called leading zero suppress display), the light emitting time in the upper digit is shortened in comparison with a lower digit so that a problem similar to the above problem is caused.

Disclosure of the Invention

The present invention resides in a luminous display unit having plural light emitting portions by using a self light emitting element reduced in light emitting luminance in accordance with a light emitting time and having differences in light emitting time in their light emitting portions, and characterized in that, when a light emitting mode in said light emitting portions is regularly determined, said light emitting time is presumed from light emitting frequencies of said light emitting portions calculated from said light emitting mode, and the light emitting luminances are set to be different from each other from the first in a light emitting portion having a large light emitting frequency and a light emitting portion having a small light emitting frequency at a using time of said luminous display unit so as not to recognize a difference in light emitting luminance caused between both the light emitting portions at said using time. For example, each of luminous display units 100, 110 has plural segments 21*a* to 21*g* (light emitting portions) by using an OLED (a self light emitting element) reduced in light emitting luminance in accordance with a light emitting time and has differences in light emitting time in their light emitting portions. When a light emitting mode in the segments 21*a* to 21*g* is regularly determined, the light emitting time of each of the segments 21*a* to 21*g* is presumed from light emitting frequencies of the segments 21*a* to 21*g* calculated from this light emitting mode, and the light emitting luminances are set to be different from each other from the first in a light emitting portion having a large light emitting frequency and a light emitting portion having a small light emitting frequency at a using time of each of the luminous display units 100, 110 so as not to recognize a difference in light emitting luminance caused between both the light emitting portions at the using time. Thus, the generation of a large difference in light emitting luminance of each of the segments 21*a* to 21*g* is prevented at the using time of each of the luminous display units 100, 110 so that goods property can be maintained.

The present invention also resides in a luminous display unit having plural light emitting portions by using a self light emitting element reduced in light emitting luminance in accordance with a light emitting time and having differences in light emitting time in their light emitting portions, and characterized in that, when a light emitting mode in said light emitting portions is regularly determined, said light emitting time is presumed from light emitting frequencies of said light emitting portions calculated from said light emitting mode, and the light emitting luminances are set to be different from each other from the first in a light emitting portion having a large light emitting frequency and a light emitting portion having a small light emitting frequency at a using time of said luminous display unit such that a difference in light emitting luminance caused between both the light emitting portions lies within 30% of a high light emitting luminance among the light emitting luminances at said using time. For example, each of luminous display units 100, 110 has plural segments 21*a* to 21*g* (light emitting portions) by using an OLED (a self light emitting element) reduced in light emitting luminance in accordance with a light emitting time and has differences in light emitting time in their light emitting portions. When a light emitting mode in the segments 21*a* to 21*g* is regularly determined, the light emitting time of each of the segments 21*a* to 21*g* is presumed from light emitting frequencies of the segments 21*a* to 21*g* calculated from this light emitting mode, and the light emitting luminances are set to be different from each other from the first in a light emitting portion having a large light emitting frequency and a light emitting portion having a small light emitting frequency at a using time of each of the luminous display units 100, 110 such that a difference in light emitting luminance caused between both the light emitting portions lies within 30% of a high light emitting luminance among the light emitting luminances at said using time. Thus, the generation of a large difference in light emitting luminance of each of the segments 21*a* to 21*g* is prevented at the using time of each of the luminous display units 100, 110 so that goods property can be maintained.

The present invention also resides in a luminous display unit having plural light emitting portions by using a self light emitting element reduced in light emitting luminance in accordance with a light emitting time and having differences in light emitting time in their light emitting portions, and characterized in that, when a light emitting mode in said light emitting portions is regularly determined, said light emitting time is presumed from light emitting frequencies of said light emitting portions calculated from said light emitting mode, and the light emitting luminance of a light emitting portion having a small light emitting frequency is set to be lower than that of a light emitting portion having a large light emitting frequency from the first with respect to the light emitting portion having a large light emitting frequency and the light emitting portion having a small light emitting frequency at a using time of said luminous display unit such that a difference in light emitting luminance caused between both the light emitting portions lies within 30% of a high light emitting luminance among the light emitting luminances at said using time. For example, each of luminous display units 100, 110 has plural segments 21*a* to 21*g* (light emitting portions) by using an OLED (a self light emitting element) reduced in light emitting luminance in accordance with a light emitting time and has differences in light emitting time in their light emitting portions. When a light emitting mode in the segments 21*a* to 21*g* is regularly determined, the light emitting time of each of the segments 21*a* to 21*g* is presumed from light emitting frequencies of the segments 21*a* to 21*g* calculated from this light emitting mode, and the light emitting luminance of a light emitting portion having a small light emitting frequency is set to be lower than that of a light emitting portion having a large light emitting frequency from the first with respect to the light emitting portion having a large light emitting frequency and the light emitting portion having a small light emitting frequency at a using time of each of the luminous display units 100, 110 such that a difference in light emitting luminance caused between both the light emitting portions lies within 30% of a high light emitting luminance among the light emitting luminances at said using time. Thus, the generation of a large difference in light emitting luminance of each of the segments 21*a* to 21*g* is prevented at the using time of each of the luminous display units 100, 110 so that goods property can be maintained.

The present invention also resides in a luminous display unit having plural light emitting portions by using a self light emitting element reduced in light emitting luminance in accordance with a light emitting time and having differences in light emitting time in their light emitting portions, and characterized in that the light emitting luminance of a light emitting portion having a long light emitting time and the light emitting luminance of a light emitting portion having a short light emitting time at a using time of said luminous display unit are set to be different from each other from the first so as not to recognize a difference in light emitting luminance caused between both the light emitting portions at said using time. For example, each of luminous display units 100, 110 has plural segments 21*a* to 21*g* (light emitting portions) by using an OLED (a self light emitting element) reduced in light emitting luminance in accordance with a light emitting time and has differences in light emitting time in their light emitting portions. The light emitting luminance of a light emitting portion having a long light emitting time and the light emitting luminance of a light emitting portion having a short light emitting time at a using time of each of the luminous display units 100, 110 are set to be different from each other from the first so as not to recognize a difference in light emitting luminance caused between both the light emitting portions at said using time. Thus, the generation of a large difference in light emitting luminance of each of the segments 21*a* to 21*g* is prevented at the using time of each of the luminous display units 100, 110 so that goods property can be maintained.

The present invention also resides in a luminous display unit having plural light emitting portions by using a self light emitting element reduced in light emitting luminance in accordance with a light emitting time and having differences in light emitting time in their light emitting portions, and characterized in that the light emitting luminance of a light emitting portion having a long light emitting time and the light emitting luminance of a light emitting portion having a short light emitting time at a using time of said luminous display unit are set to be different from each other from the first such that a difference in light emitting luminance caused between both the light emitting portions lies within 30% of a high light emitting luminance among the light emitting luminances at said using time. For example, each of luminous display units 100, 110 has plural segments 21*a* to 21*g* (light emitting portions) by using an OLED (a self light emitting element) reduced in light emitting luminance in accordance with a light emitting time and has differences in light emitting time in their light emitting portions. The light emitting luminance of a light emitting portion having a long light emitting time and the light emitting luminance of a light emitting portion having a short light emitting time at a using time of each of the luminous display units 100, 110 are set to be different from each other from the first such that a difference in light emitting luminance caused between the light emitting portions lies within 30% of a high light emitting luminance among the light emitting luminances at said using time. Thus, the generation of a large difference in light emitting luminance of each of the segments 21*a* to 21*g* is prevented at the using time of each of the luminous display units 100, 110 so that goods property can be maintained.

Further, the present invention resides in a luminous display unit having plural light emitting portions by using a self light emitting element reduced in light emitting luminance in accordance with a light emitting time and having differences in light emitting time in their light emitting portions, and characterized in that the light emitting luminance of a light emitting portion having a short light emitting time is set to be lower than that of a light emitting portion having a long light emitting time from the first with respect to the light emitting portion having a long light emitting time and the light emitting portion having a short light emitting time at a using time of said luminous display unit such that a difference in light emitting luminance caused between both the light emitting portions lies within 30% of a high light emitting luminance among the light emitting luminances at said using time. For example, each of luminous display units 100, 110 has plural segments 21*a* to 21*g* (light emitting portions) by using an OLED (a self light emitting element) reduced in light emitting luminance in accordance with a light emitting time and has differences in light emitting time in their light emitting portions. The light emitting luminance of a light emitting portion having a short light emitting time is set to be lower than that of a light emitting portion having a long light emitting time from the first with respect to the light emitting portion having a long light emitting time and the light emitting portion having a short light emitting time at a using time of each of the luminous display units 100, 110 such that a difference in light emitting luminance caused between both the light emitting portions lies within 30% of a high light emitting luminance among the light emitting luminances at said using time. Thus, the generation of a large difference in light emitting luminance of each of the segments 21*a* to 21*g* is prevented at the using time of each of the luminous display units 100, 110 so that goods property can be maintained.

The luminous display unit is particularly characterized in that said self light emitting element is an organic electroluminescence element. For example, in the case of the OLED as a light emitting element, a change in light emitting luminance according to the light emitting time (light emitting frequency) is notable, and the generation of a large difference in light emitting luminance of each of the segments 21*a* to 21*g* is prevented at the using time of each of the luminous display units 100, 110 so that goods property can be maintained.

The luminous display unit is particularly characterized in that said luminous display unit is a display unit for a vehicle displaying a numeral of plural digits. For example, in the case of the display unit for a vehicle displaying a numeral of plural digits as the luminous display units 100, 110, the change in light emitting luminance is notable since it is expected that the display unit is used for a long period such as several hundred thousand Km or several years. In this case, the generation of a large difference in light emitting luminance of each of the segments 21*a* to 21*g* is also prevented at the using time of each of the luminous display units 100, 110 so that goods property can be maintained.

BEST MODE FOR CARRYING OUT THE INVENTION

Figure 1:
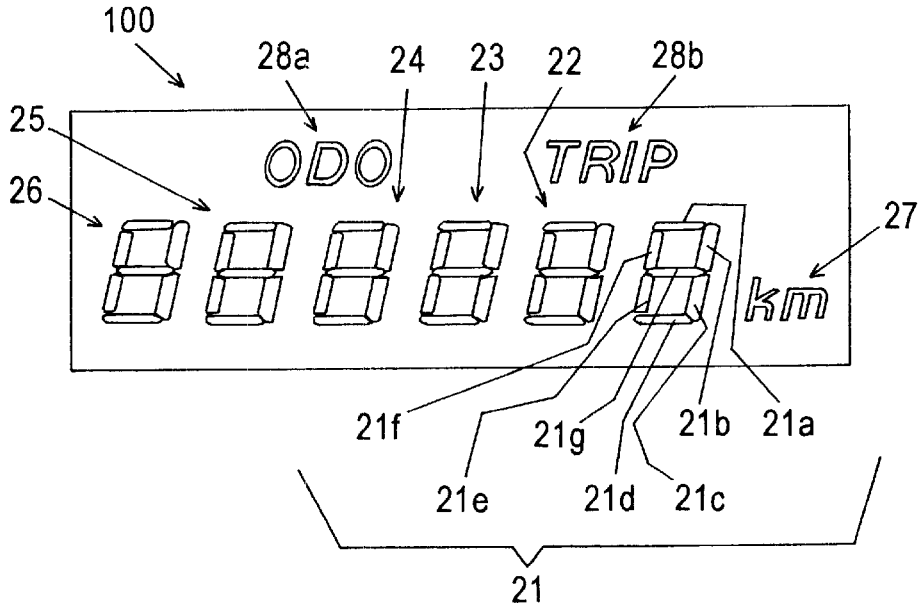
FIG. 1 is a plan view of a first embodiment of the present invention.

The present invention will be explained on the basis of embodiments shown in the accompanying drawings, but the same portions as the above prior art, or portions corresponding to those in the above prior art are designated by the same reference numerals, and their detailed explanations are omitted here.

Figure 2:
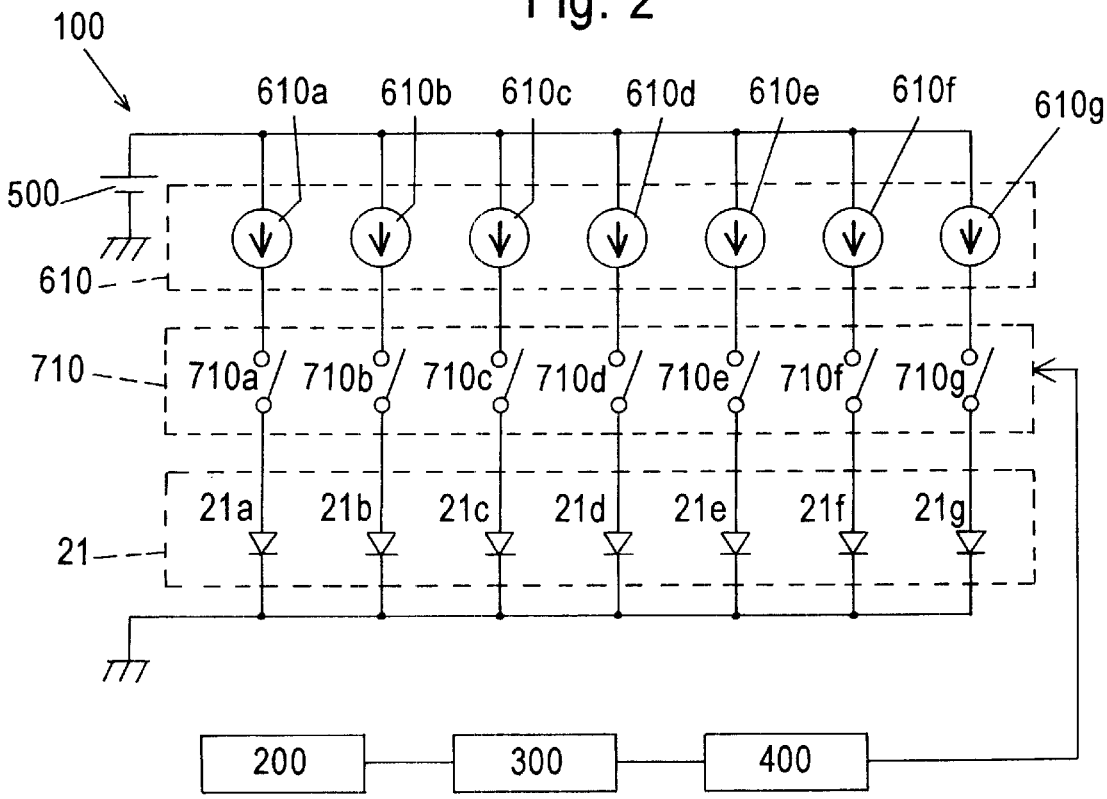
FIG. 2 is a circuit diagram in the above embodiment.
Figure 3:
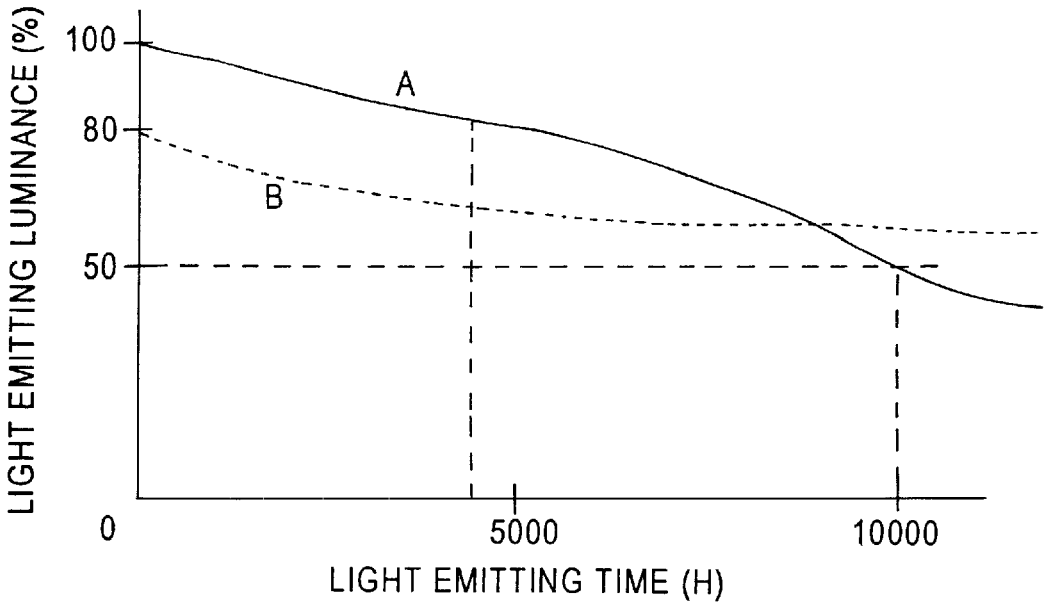
FIG. 3 is a characteristic graph for explaining a light emitting state in the above embodiment.
Figure 5:
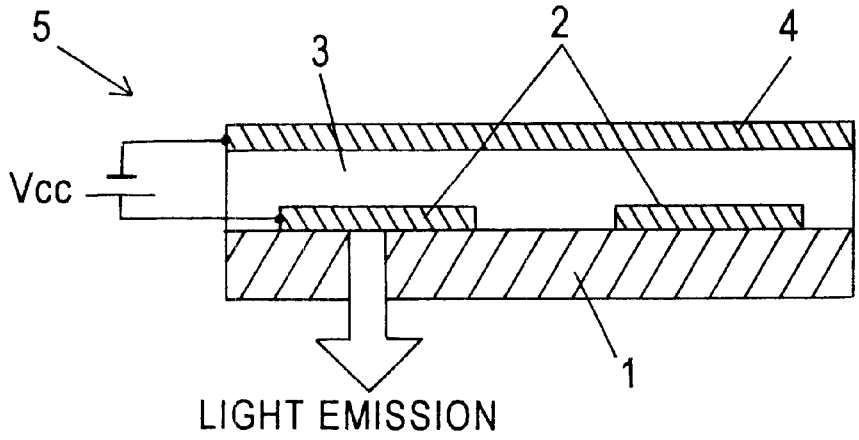
Fig. 5 (PRIOR ART)
FIG. 5 is a cross-sectional view showing the structure of an organic electroluminescence element.
Figure 6:
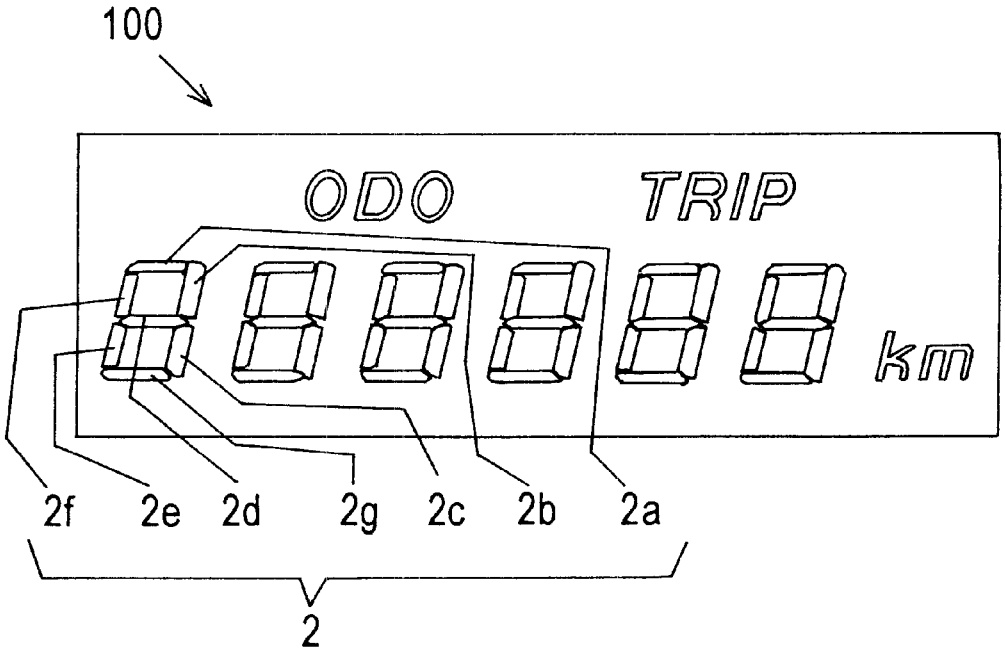
Fig. 6 (PRIOR ART)
FIG. 6 is a front view of a luminous display unit in the prior art.

FIGS. 1 to 3 relate to a first embodiment of the present invention. Reference numeral 100 designates a luminous display unit in the present invention which is a digital type distance recorder as a display unit for a vehicle using an OLED 5 (see FIG. 5).

An anode 2 (see FIG. 5) is divided into six groups 21 to 26. The group 21 is divided into seven segments 21*a* to 21*g* as light emitting portions arranged in an 8-shape, and artificially displays Arabic numerals "0" to "9". The other groups 22 to 26 also have a construction similar to that of the group 21. Numerals of six digits can be displayed by arranging a plurality of the respective groups 21 to 26 in a transversal direction. The group 21 is located in a least significant digit, and the group 26 is located in a most significant digit.

Reference numeral 27 designates a unit mark portion which is one portion of the anode 2 and displays a unit "Km" of a running distance. Reference numeral 28*a* designates an ODO mark portion which is one portion of the anode 2 and displays a mark "ODO" showing that the digital type distance recorder is set to a mode of an accumulating distance recorder. Reference numeral 28*b* designates a trip mark portion which is one portion of the anode 2 and displays a mark "TRIP" showing that the digital type distance recorder is set to a mode of an interval distance recorder. The ODO mark portion 28*a* and the trip mark portion 28*a* are selectively switched by an unillustrated switch so that only one of these mark portions is displayed. The display in the groups 21 to 26 is also simultaneously switched. The unit mark portion 27, the ODO mark portion 28*a* and the trip mark portion 28*b* are also light emitting portions.

FIG. 2 shows a circuit construction of such a digital type distance recorder (luminous display unit) 100. Reference numeral 200 designates a sensor for outputting a pulse signal in accordance with the number of rotations of a wheel. Reference numeral 300 designates a counter for counting an output (pulse number) from the sensor 200. Reference numeral 400 designates an arithmetic control section constructed by a microcomputer, etc. The arithmetic control section 400 calculates a running distance from the counting number of the counter 300 by an arithmetic operation, and outputs a control signal so as to perform display in the above arithmetic operation, by the digital type distance recorder 100. Reference numerals 500, 610 and 710 respectively designate a power circuit constructed by a battery mounted to a car, etc., a constant electric current circuit section for obtaining a constant electric current from the power circuit 500, and a switching section. The switching section 710 has switches 710*a* to 710*g* for supplying or interrupting electric currents from constant electric current circuits 610*a* to 610*g* of the constant electric current circuit section 610 to the segments 21*a* to 21*g* so as to display a predetermined numeral on the basis of commands from the arithmetic control section 400.

In FIG. 2, only the group 21 displaying the least significant digit is shown, and the other groups 22 to 26 are omitted. However, sections (constant electric current circuit sections 620 to 660 and switching sections 720 to 760 which are not illustrated in the drawings) corresponding to the constant electric current circuit section 610 and the switching section 710 are also respectively connected to the other groups 22 to 26, and these groups 22 to 26 also display a predetermined numeral on the basis of commands from the arithmetic control section 400. In the following explanation, the group 21 is explained, but portions corresponding to the other groups 22 to 26 similarly hold true unless it is emphatically said.

Figure 7:
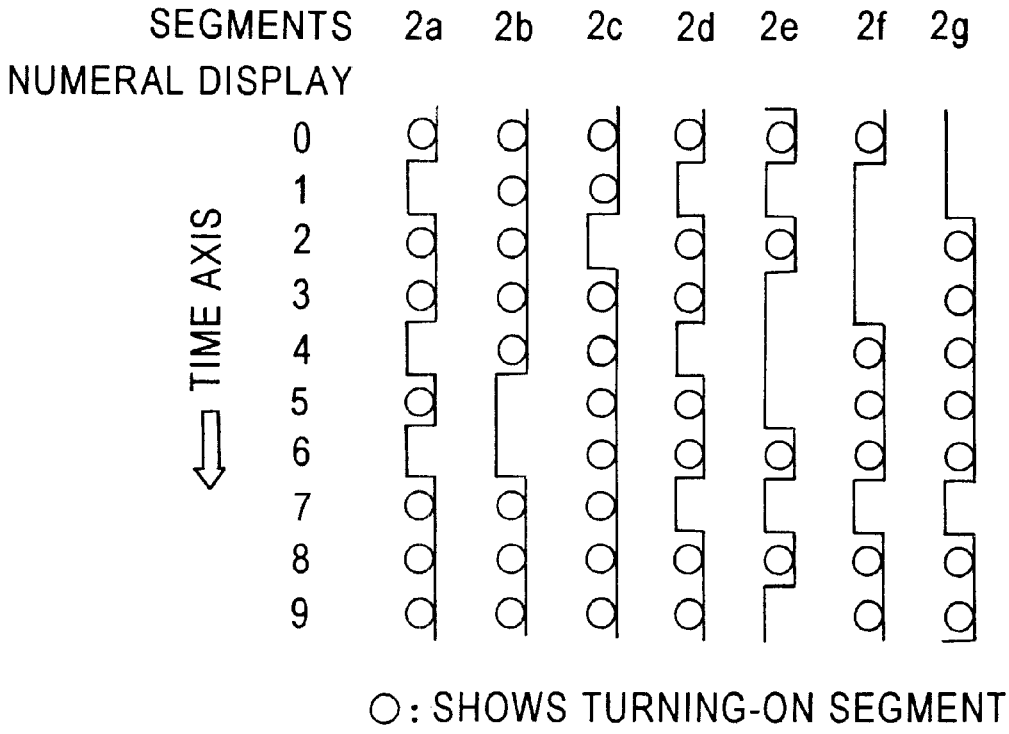
Fig. 7 (PRIOR ART)
FIG. 7 is a time series view for explaining a light emitting state in the prior art.

As mentioned above (see FIG. 7) with respect to a light emitting frequency of each of the segments 21*a* to 21*g* in the display of numerals "0" to "9" in the group 21, the segment 21*c* has a maximum light emitting frequency of nine times, and the segment 21*e* has a minimum light emitting frequency of four times. When it is supposed that a light emitting time of each of the numerals "0" to "9" is uniform, the light emitting time of the segment 2*c* is 2.25 times the light emitting time of the segment 2*e*. Thus, when a light emitting mode of each of the segments 21*a* to 21*g* (light emitting portions) is regularly determined so as to sequentially change the numerals from "0" to "9", the light emitting time can be presumed from the light emitting frequency of each of the segments 21*a* to 21*g* calculated from the above light emitting mode.

Accordingly, as shown by a solid line A of FIG. 3, even when the light emitting time of the segment 21*c* is ten thousand hours as a half-life, the light emitting time of the segment 21*e* is about 4444 hours and light emitting luminance is about 82% of the original light emitting luminance. Therefore, when segments 21*c* and 21*e* in the group 21 simultaneously emit light and display numerals "0", "6" and "8", the difference in light emitting luminance between both the segments is 30% or more. Accordingly, since the difference in light emitting luminance can be easily recognized, a problem exists in that a user has a feeling of physical disorder, etc. so that goods property is greatly damaged.

To solve this problem, in this embodiment, initial luminance of the segment 21*e* having a short light emitting time is set to be small in comparison with the segment 21*c* having a long light emitting time with respect to a using time of the digital type distance recorder (luminous display unit) 100. Namely, the initial light emitting luminance of the segment 21*e* is set to about 80% of the normal light emitting luminance. Thus, characteristics of the light emitting luminance of the segment 21*e* are provided as shown by a broken line B of FIG. 3.

Accordingly, the difference in light emitting luminance between the segments 21*c* and 21*e* is originally about 20%. Further, the light emitting luminance of the segment 21*e* is about 70% even when the light emitting time of the segment 21*c* reaches ten thousand hours as a half-life and the light emitting time of the segment 21*e* becomes about 4444 hours. Therefore, the difference in light emitting luminance does not change and is about 20% as it is. In the case of such a difference in light emitting luminance, it is difficult for a user to recognize the difference in light emitting luminance between both the segments so that these light emitting luminances cannot be almost discriminated from each other. Accordingly, goods property can be maintained without causing a feeling of physical disorder in the user.

To realize this, it is sufficient to adjust an electric current value by each of the constant electric current circuits 610*a* to 610*g* of the constant electric current circuit section 610. Since the light emitting luminance is proportional to the electric current value, the above characteristics can be obtained by reducing the electric current value from the constant electric current circuit 610*e* supplying an electric current to the segment 21*e*.

As explained in the comparison of the segments 21*c* and 21*e*, the light emitting time of each of the segments 21*a* to 21*g* is presumed from an expected using time of the digital type distance recorder 100, and the individual electric current values of the segments 21*a* to 21*g*, i.e., the characteristics of the light emitting luminances may be set by adjusting the low electric current circuits 610*a* to 610*g* of the constant electric current circuit section 610 such that the difference between high and low light emitting luminances lies within 30% of the high light emitting luminance among the light emitting luminances within this using time. However, as in this embodiment, it is possible to obtain effects of maintaining goods property without recognizing the difference in light emitting luminance by comparing only maximum and minimum light emitting luminances and setting the characteristics between these two light emitting luminances as mentioned above.

Further, in the above embodiment, the difference in light emitting luminance between the segment 21*e* having a shortest light emitting time and the segment 21*c* having a longest light emitting time is restrained by reducing the electric current value from the constant electric current circuit 610*e* supplying the electric current to the segment 21*e* having a shortest light emitting time. However, reversely, it is possible to easily understand that the difference in light emitting luminance between the segment 21*c* having a longest light emitting time and the segment 21*e* having a shortest light emitting time may be also restrained by highly setting the electric current value from the constant electric current circuit 610c supplying the electric current to the segment 21*c* having a longest light emitting time.

Such setting is similarly performed with respect to each of groups 22 to 26 so that the difference in light emitting luminance in each of the groups 22 to 26 can be restrained.

When no numeral "0" is displayed on an upper digit side, i.e., when "120" having no numerals "0" in upper three digits is displayed as a blank display instead of "000120" displaying numerals "0" in the upper three digits in display of the numeral "120", the light emitting time is shortened from the group 21 as a least significant digit to an upper digit side. The light emitting time of the group 26 as a most significant digit is shortest. Therefore, there is a possibility that a problem similar to the difference in light emitting luminance in the same digit is also caused between digits (groups 21 to 26).

In a construction for avoiding this problem, timing for starting light emission in each digit in the digital type distance recorder 100 is assumed, and unillustrated constant electric current circuit sections 620 to 660 supplying electric currents to the respective digits (groups 22 to 26) are adjusted such that the difference between high and low light emitting luminances lies within 30% of the high light emitting luminance among the light emitting luminances. Namely, the electric current value on the upper digit side is set to be sequentially reduced in comparison with the group 21, or the electric current value on a lower digit side is set to be sequentially increased in comparison with the group 26.

Figure 4:
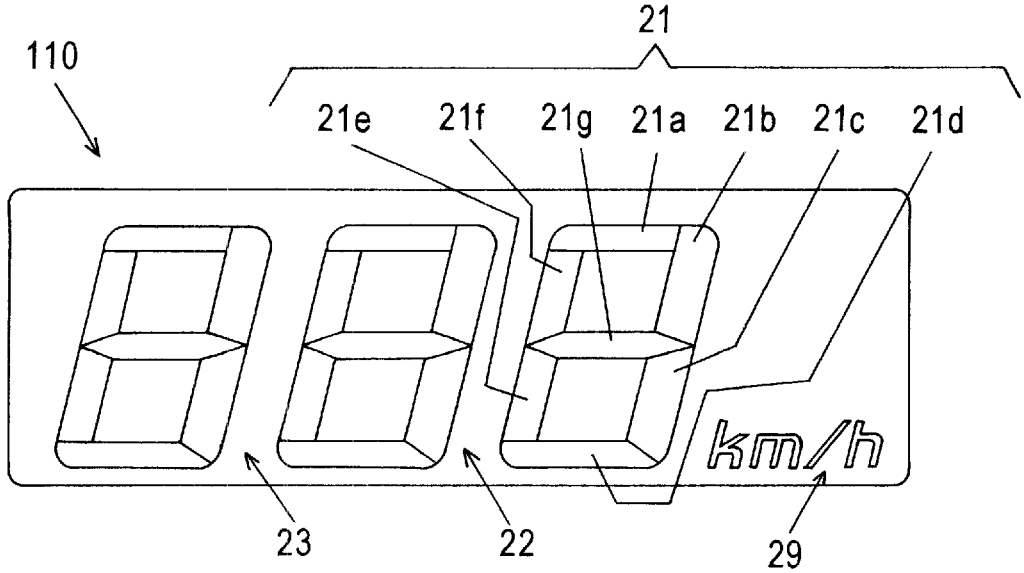
FIG. 4 is a plan view of a second embodiment of the present invention.

FIG. 4 shows a case in which the luminous display unit using the OLED 5 (see FIG. 5) is utilized as a digital type travel speed meter 110 of a display unit for a vehicle. Namely, an anode 2 (see FIG. 5) is divided into three groups 21 to 23, and the group 21 is divided into seven segments 21*a* to 21*g* as light emitting portions arranged in an 8-shape, and displays numerals "0" to "9". The other groups 22 and 23 also have a construction similar to that of the group 21. Thus, numerals of three digits can be displayed by arranging a plurality of the respective groups 21 to 23 in a transversal direction. The group 21 is located in a least significant digit, and the group 23 is located in a most significant digit. Reference numeral 29 designates a unit mark portion which is one portion of the anode 2 and displays the unit "Km/h" of a travel speed. The unit mark portion 29 is also a light emitting portion.

In the case of the travel speed meter 110, different from the distance recorder 100, there is no regular property in the numeral displayed in each digit. Accordingly, it is considered that it is not effective so much to set the value of an electric current supplied to adjust the light emitting luminance of each segment in each digit unit as mentioned in the preceding paragraph of the above embodiment.

However, it is known from an experience low in a general running environment that a running opportunity of one hundred Km/h or more is very small in comparison with running at a travel speed equal to or lower than one hundred Km/h. Namely, in the case of the travel speed meter 110, when a numeric value in an upper digit is "0", this numeric value is not displayed. Accordingly, the light emitting time of the group 23 as a third digit is short in comparison with the light emitting times of the group 21 as a first digit and the group 22 as a second digit. Therefore, it can be estimated that differences in light emitting luminance are caused between the groups 21, 22 and the group 23. In contrast to this, a running opportunity at a speed lower than ten Km/h is small, and groups 21 and 22 are almost simultaneously displayed so that there is no large difference in light emitting time between the groups 21 and 22. Therefore, it can be estimated that no difference in light emitting luminance is widened to such an extent that this difference can be recognized.

In such a construction, it is effective in maintenance of goods property to restrain the difference in light emitting luminance between the groups 21, 22 and the group 23. To realize this, timing for starting light emission in the most significant digit in the digital type travel speed meter 110 is supposed, and an unillustrated constant electric current circuit section supplying an electric current to each digit (groups 21 to 23) is adjusted such that the difference between high and low light emitting luminances lies within 30% of the high light emitting luminance among the light emitting luminances. Namely, the electric current value of the group 23 is set to be small in comparison with the groups 21, 22, or the electric current values of the groups 21, 22 are set to be large in comparison with the group 23. Each electric current value at this time is determined on the basis of an experience law, etc. However, as mentioned above, when the difference in light emitting luminance becomes a value corresponding to 30% of the high light emitting luminance among the light emitting luminances or more, the difference in light emitting luminance between both the groups can be recognized. Therefore, it is necessary to set the original difference in light emitting luminance such that this original difference lies within 30% of the high light emitting luminance among the light emitting luminances.

In each of the above embodiments, it is considered that display time is long in ensign portions of the unit mark portion 27, the ODO mark portion 28*a*, the trip mark portion 28*b* (see FIG. 1) and the unit mark portion 29 (see FIG. 4) in comparison with a display portion displaying a numeral so that a reduction in light emitting luminance is rapidly caused. Therefore, there is a high possibility that the difference in light emitting luminance between both the portions can be recognized. To dissolve this problem, it is sufficient to adjust the unillustrated constant electric current circuit section for supplying electric currents to both the portions as mentioned above. Namely, an electric current value in the display portion displaying a numeral is set to be small in comparison with the ensign portion, or an electric current value in the ensign portion is set to be large in comparison with the display portion displaying a numeral. Each electric current value at this time is determined on the basis of an experience law, etc. However, as mentioned above, when the difference in light emitting luminance becomes a value corresponding to 30% of the high light emitting luminance among the light emitting luminances or more, the difference in light emitting luminance between both the portions can be recognized. Therefore, it is necessary to set the original difference in light emitting luminance such that this original difference lies within 30% of the high light emitting luminance among the light emitting luminances.

In each of the above embodiments, the distance recorder 100 and the travel speed meter 110 are explained. However, the present invention can be applied to a luminous display unit in which differences are caused in light emitting time in plural light emitting portions in accordance with existence of these light emitting portions. For example, the present invention can be also applied to a digital type clock and a digital type engine tachometer.

In each of the above embodiments, the luminous display unit using the OLED is explained, but the present invention can be also applied to a luminous display unit using a self light emitting element in which the light emitting luminance is reduced in accordance with the light emitting time. For example, the present invention can be also applied to a fluorescent display tube (FLT) and a light emitting diode (LED).

However, a change in the light emitting luminance according to the light emitting time (light emitting frequency) is notable in an organic electroluminescence element. The present invention is suitable in a luminous display unit with such an organic electroluminescence element as a self light emitting element.

In a display unit for a vehicle displaying numerals of plural digits, it is expected that this display unit is used for a long period such as several hundred thousand Km or several years. Accordingly, the change in light emitting luminance is notable, and the present invention is suitable in a luminous display unit with such a display unit for a vehicle as an object.

Industrial Applicability

As mentioned above, in the present invention, even when a luminous display unit has plural light emitting portions by using a self light emitting element reduced in light emitting luminance in accordance with a light emitting time and also has differences in light emitting time in these light emitting portions, this luminous display unit can be used for a long time without recognizing the difference in light emitting luminance so that goods property can be maintained for a long time.

What is claimed is:

1. A luminous display unit having plural light emitting portions by using a self light emitting element reduced in light emitting luminance in accordance with a light emitting time and having differences in light emitting time in their light emitting portions, and characterized in that, when a light emitting mode in said light emitting portions is regularly determined, said light emitting time is presumed from light emitting frequencies of said light emitting portions calculated from said light emitting mode, and the initial light emitting luminances are set to be different from each other in a light emitting portion having a large light emitting frequency and a light emitting portion having a small light emitting frequency during use of said luminous display unit so as not to cause a recognizable difference in light emitting luminance between both the light emitting portions during use.

2. A luminous display unit according to claim 1, wherein said self light emitting element is an organic electroluminescence element.

3. A luminous display unit according to claim 1, wherein said luminous display unit is a display unit for a vehicle displaying a numeral of plural digits.

4. A luminous display unit having plural light emitting portions by using a self light emitting element reduced in light emitting luminance in accordance with a light emitting time and having differences in light emitting time in their light emitting portions, and characterized in that, when a light emitting mode in said light emitting portions is regularly determined, said light emitting time is presumed from light emitting frequencies of said light emitting portions calculated from said light emitting mode, and the initial light emitting luminances are set to be different from each other in a light emitting portion having a large light emitting frequency and a light emitting portion having a small light emitting frequency during use of said luminous display unit such that a difference in light emitting luminance caused between both the light emitting portions lies within 30% of a high light emitting luminance among the light emitting luminances during use.

5. A luminous display unit having plural light emitting portions by using a self light emitting element reduced in light emitting luminance in accordance with a light emitting time and having differences in light emitting time in their light emitting portions, and characterized in that, when a light emitting mode in said light emitting portions is regularly determined, said light emitting time is presumed from light emitting frequencies of said light emitting portions calculated from said light emitting mode, and the initial light emitting luminance of a light emitting portion having a small light emitting frequency is set to be lower than that of a light emitting portion having a large light emitting frequency with respect to the light emitting portion having a large light emitting frequency and the light emitting portion having a small light emitting frequency during use of said luminous display unit such that a difference in light emitting luminance caused between both the light emitting portions lies within 30% of a high light emitting luminance among the light emitting luminances during use.

6. A luminous display unit having plural light emitting portions by using a self light emitting element reduced in light emitting luminance in accordance with a light emitting time and having differences in light emitting time in their light emitting portions, and characterized in that the initial light emitting luminance of a light emitting portion having a long light emitting time and the light emitting luminance of a light emitting portion having a short light emitting time during use of said luminous display unit are set to be different from each other so as not to cause a recognizable difference in light emitting luminance between both the light emitting portions during use.

7. A luminous display unit having plural light emitting portions by using a self light emitting element reduced in light emitting luminance in accordance with a light emitting time and having differences in light emitting time in their light emitting portions, and characterized in that the initial light emitting luminance of a light emitting portion having a long light emitting time and the light emitting luminance of a light emitting portion having a short light emitting time during use of said luminous display unit are set to be different from each other such that a difference in light emitting luminance caused between both the light emitting portions lies within 30% of a high light emitting luminance among the light emitting luminances during use.

8. A luminous display unit having plural light emitting portions by using a self light emitting element reduced in light emitting luminance in accordance with a light emitting time and having differences in light emitting time in their light emitting portions, and characterized in that the initial light emitting luminance of a light emitting portion having a short light emitting time is set to be lower than that of a light emitting portion having a long light emitting time with respect to the light emitting portion having a long light emitting time and the light emitting portion having a short light emitting time during use of said luminous display unit such that a difference in light emitting luminance caused between both the light emitting portions lies within 30% of a high light emitting luminance among the light emitting luminances during use.

* * * * *